US009073721B2

(12) United States Patent
Stodd

(10) Patent No.: US 9,073,721 B2
(45) Date of Patent: Jul. 7, 2015

(54) SYSTEM FOR HIGH SPEED FEEDING A THIN SHEET METAL STRIP INTO A RECIPROCATING PRESS

(75) Inventor: R. Peter Stodd, Dayton, OH (US)

(73) Assignee: Global Feeding Systems, Inc., Dayton, OH (US)

( * ) Notice: Subject to any disclaimer, the term of this patent is extended or adjusted under 35 U.S.C. 154(b) by 440 days.

(21) Appl. No.: 12/807,262

(22) Filed: Sep. 1, 2010

(65) Prior Publication Data

US 2012/0048907 A1 Mar. 1, 2012

(51) Int. Cl.

| | |
|---|---|
| ***B65H 20/04*** | (2006.01) |
| ***B65H 20/32*** | (2006.01) |
| ***B21D 22/20*** | (2006.01) |
| ***B21D 43/02*** | (2006.01) |

(52) U.S. Cl.

CPC ..... *B65H 20/04* (2013.01); *B21D 22/206* (2013.01); *B21D 43/021* (2013.01); *B65H 20/32* (2013.01); *B65H 2511/112* (2013.01); *B65H 2555/24* (2013.01); *B65H 2701/173* (2013.01)

(58) Field of Classification Search

CPC .. B96H 20/04; B96H 20/32; B96H 2511/112; B96H 2555/24; B96H 2701/173; B21D 43/021; B21D 22/206

USPC ..... 226/4, 8, 24, 42, 43, 91, 113, 115–117, 226/118.1, 143, 152, 154, 196.1; 242/418.1

See application file for complete search history.

(56) References Cited

U.S. PATENT DOCUMENTS

| | | | | | |
|---|---|---|---|---|---|
| 1,408,894 | A | * | 3/1922 | Ganke et al. | 83/230 |
| 2,025,418 | A | | 12/1935 | Moore | |
| 2,345,656 | A | * | 4/1944 | Calleson et al. | 427/401 |
| 2,480,781 | A | * | 8/1949 | Simpson | 83/65 |
| 2,753,183 | A | * | 7/1956 | Wiig et al. | 226/41 |
| 3,177,749 | A | | 4/1965 | Best et al. | |
| 3,428,232 | A | * | 2/1969 | Haas et al. | 226/115 |
| 3,483,782 | A | * | 12/1969 | Eyberger | 83/202 |
| 3,513,523 | A | * | 5/1970 | Mittermaier et al. | 29/564.6 |
| 3,707,255 | A | * | 12/1972 | Ridgway et al. | 226/136 |
| 3,817,067 | A | * | 6/1974 | Voorehes et al. | 72/11.4 |
| 3,974,949 | A | * | 8/1976 | Petersen | 226/42 |
| 4,011,976 | A | * | 3/1977 | Greer | 226/8 |
| 4,078,416 | A | * | 3/1978 | Voorhees et al. | 72/419 |
| 4,138,913 | A | | 2/1979 | Gentile | |
| 4,489,872 | A | | 12/1984 | Bolton et al. | |
| 4,561,581 | A | | 12/1985 | Kelly | |
| 4,953,808 | A | | 9/1990 | Craycraft | |
| 5,451,011 | A | | 9/1995 | Frost et al. | |
| 5,501,412 | A | | 3/1996 | McAleavey | |
| 5,622,330 | A | | 4/1997 | Sharp et al. | |
| 5,833,105 | A | | 11/1998 | Stuber | |
| 5,857,374 | A | | 1/1999 | Stodd | |
| 5,868,296 | A | * | 2/1999 | Gentile et al. | 226/35 |
| 2004/0079780 | A1 | * | 4/2004 | Kato | 226/24 |

* cited by examiner

*Primary Examiner* — William E Dondero

(74) *Attorney, Agent, or Firm* — Jacox, Meckstroth & Jenkins

(57) ABSTRACT

A sheet metal strip is directed from a supply coil into a unitized system including a frame supporting a feed roll driven by a variable speed motor. The strip is directed upwardly from the feed roll between vertical guide rods to produce an inverted U-shaped vertical loop detected by sensors connected to control the feed roll motor. A servo driven index roll receives and advances the strip into tooling within a reciprocating press. Vibration insulators support the frame from a base stand mounted on air casters which provide for quickly removing the system from the press. The axial length of each roll is less than the width of the strip and engages only a center portion of the strip. A second index roll driven by a servo motor may be used on the press to provide push/pull advancement of the strip through the press.

3 Claims, 3 Drawing Sheets

SYSTEM FOR HIGH SPEED FEEDING A THIN SHEET METAL STRIP INTO A RECIPROCATING PRESS

BACKGROUND OF THE INVENTION

This invention relates to apparatus for feeding a strip of thin sheet metal from a supply coil into die set tooling within a reciprocating press, for example, tooling as disclosed in applicant's U.S. Pat. No. 5,857,374 for the high speed production of aluminum can shells. Various types of sheet metal feeding equipment or apparatus are disclosed in U.S. Pat. No. 2,025,418, No. 3,177,749, No. 4,138,913, No. 4,489,872, No. 4,561,581, No. 4,953,808, No. 5,501,412, No. 5,833,105, No. 5,451,011 and No. 5,622,330. When feeding a thin sheet of metal or aluminum strip into tooling within a single action or double action press, as disclosed in above mentioned U.S. Pat. No. 5,857,374, it is very desirable for the strip to be fed from a supply coil and indexed into tooling within the press at a high rate of speed in order for the press to operate at a high production speed, for example, 400 strokes per minute.

It is also desirable for the strip to be accurately and smoothly advanced into the tooling without any vibration or whipping of the strip in order to obtain higher speed feeding and also minimize overfeeding of the metal strip. It is further desirable to provide for quickly separating the strip feeding apparatus from the press to minimize down time of the press for maintenance of the press and/or tooling or replacement of the tooling. While the above identified patents disclose different forms of apparatus for receiving a web or strip of material or sheet metal strip from a supply coil and advancing the strip in successive steps into a reciprocating press, the different apparatus do not provide all of the desirable advantages mentioned above and especially high speed, precision and dependable advancement of the strip into a reciprocating press from which higher speed production is desired.

SUMMARY OF THE INVENTION

The present invention is directed to an improved system for high speed and precision advancement of a thin sheet metal strip from a supply coil into a reciprocating press. In general, the system includes a frame supporting a pinch roll adjacent a feed roll driven by variable speed drive. The rolls are positioned to receive the strip from a supply coil and direct the strip upwardly between horizontally spaced inner and outer vertical guide members or parallel spaced rods where the strip is formed by a retractable threader cap into an inverted U-shaped and continuously moving vertical loop. Loop sensors are positioned adjacent the vertical guide members and detect the top of the loop in the strip between the guide members, and the sensors precisely control the variable speed drive. From the vertical guide members, the strip is directed by inner and outer guide members or spaced rods into a pinch roll adjacent an index roll driven by a servo motor controlled in response to operation of the press. The index roll and adjacent pinch roll may be supported by the frame and direct the strip horizontally into the press. Preferably, the frame is releasably connected to the press by locators on the press, and the frame is supported by a set of vibration isolation units mounted on a base stand supported by air film casters. When the frame is released from the press, the entire system, including the frame and support stand may be quickly removed from the press for servicing of the press and/or die set tooling or replacement of the tooling.

Other features and advantages of the invention will be apparent from the following description, the accompanying drawings and the appended claims.

DESCRIPTION OF THE PREFERRED EMBODIMENTS

Figure 1:
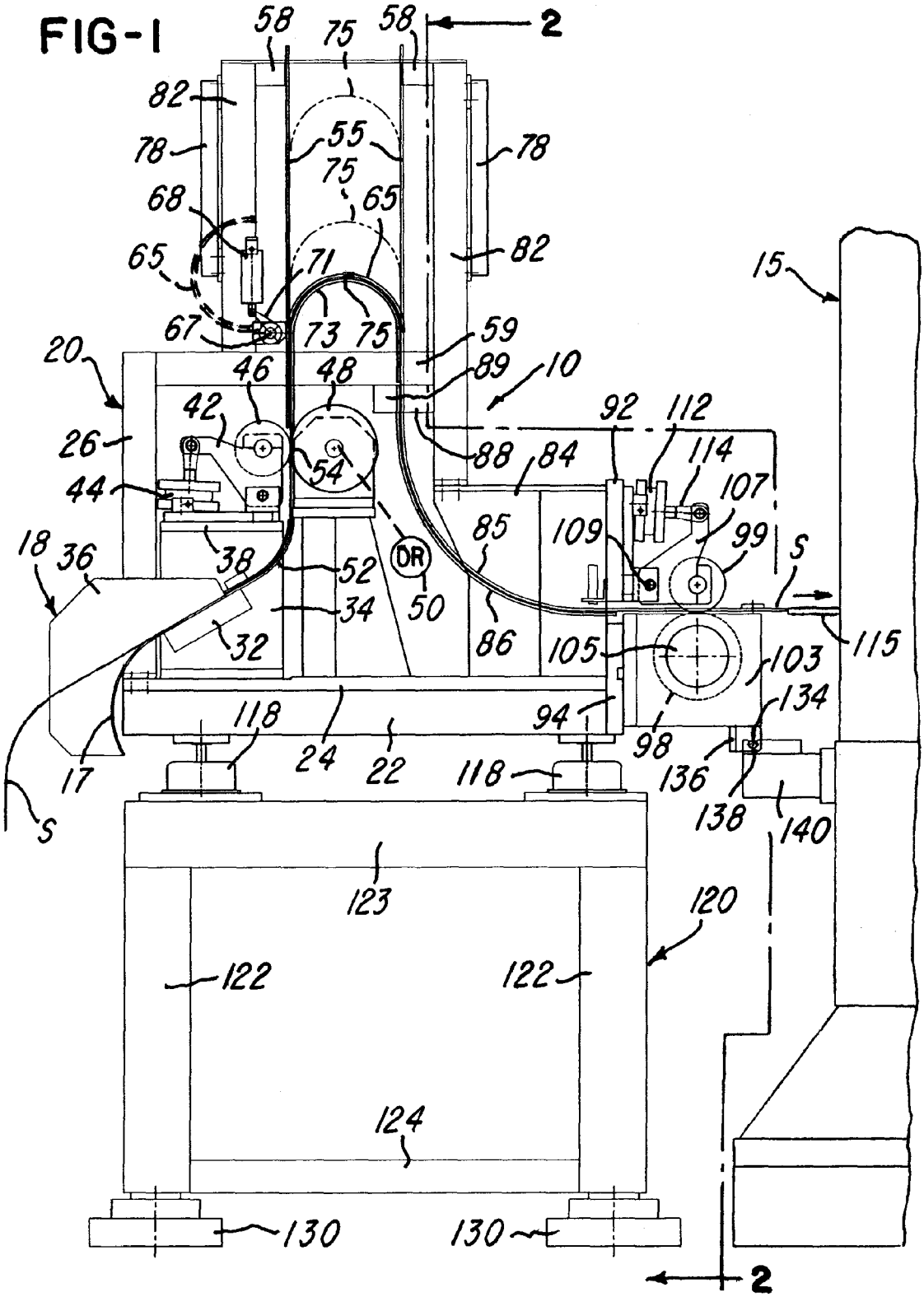
FIG. 1 is an elevational and somewhat diagrammatic view of a system for feeding a sheet metal strip into a reciprocating press and constructed in accordance with the invention.
Figure 2:
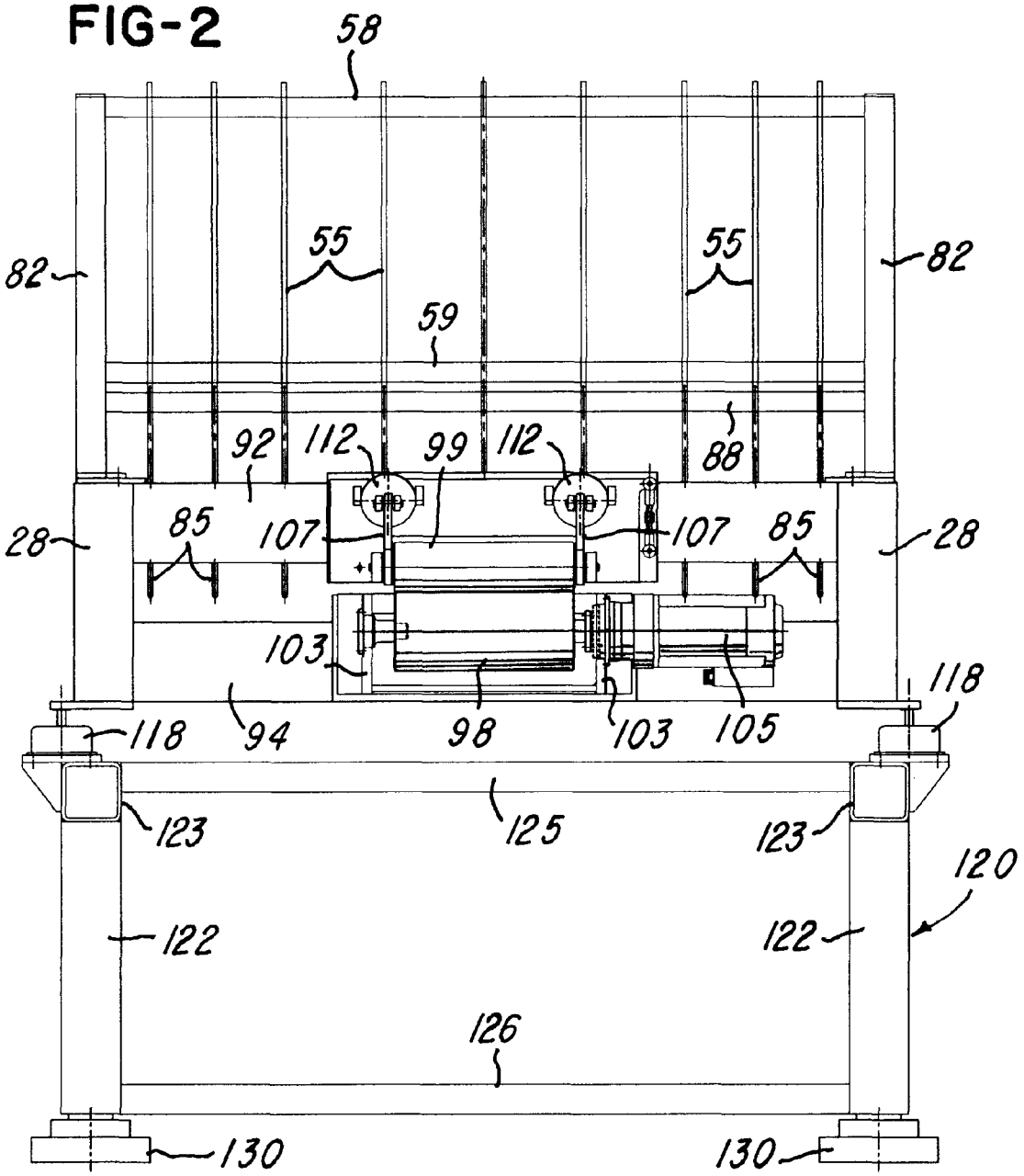
FIG. 2 is another diagrammatic elevational view of the system, taken generally on the line 2-2 of FIG. 1.

Referring to FIG. 1, a strip feeding system 10 is constructed in accordance with the invention for feeding a sheet metal or aluminum strip S from a supply coil (not shown in FIG. 1) into die set tooling within a mechanical reciprocating press 15. The system 10 receives the strip S as a continuous supply and advances the strip S horizontally or generally horizontally into a press 15 in precision predetermined increments in order for the press to operate at a higher than normal speed, for example, 500 strokes per minute. The sheet metal or aluminum strip S is directed into the system 10 from the supply coil over a curved panel 17 of a stainless steel guide chute 18. The chute is supported by a fabricated steel frame 20 which includes a horizontal and rectangular base member or base frame 22 which supports a horizontal platform 24 from which project vertical corner posts 26 and 28 (FIG. 2). The curved panel 17 is supported by a cross plate 32 which extends between vertical side brackets or plates 34 and also supports vertical side plates 36 of the chute 18.

The side plates 34 are also connected by a horizontal platform or plate 38 which supports a pair of pivotal arms 42 connected to corresponding fluid or air cylinders 44. A pinch roll 46 extends between the arms 42 and opposes an adjacent feed roll 48 driven by variable speed drive motor 50. From the chute 18, the strip S is directed upwardly by curved inside guide members in the form of parallel spaced cylindrical rods 52 and into the nip 54 between the feed roll 48 and the adjacent pinch roll 46. The strip S is fed upwardly or vertically between parallel spaced outer vertical guide members in the form of parallel spaced stainless steel cylindrical rods 55 supported by horizontal cross members 58 and 59 of the frame 20.

A strip threader cap 65, in the form of parallel spaced semi-circular rods, is supported for pivotal movement by a shaft 67 between a strip curving or threading position (FIG. 1) between the vertical outer guide rods 55 and a fully retracted position shown in dotted form in FIG. 1. The cap is pivoted by actuation of a fluid or air cylinder 68 connected to the shaft 67 by pivot arm 71. When the threader cap 65 is in its threading position, the leading end of the strip S is directed under the curved rods of the threader cap 65 and over parallel spaced semi-circular fixed guide rods 73 with downwardly projecting vertical extensions to form a downwardly facing U-shaped semi cylindrical loop 75 within the strip S being continuously fed upwardly by the driven feed roll 48 and back up pinch roll 46.

When the threader cap 65 is pivoted to its retracted position, the curved loop 75 is free to move upwardly above the guide rods 73 and between the outer vertical guide rods 55. The floating top of the loop is detected or sensed by a pair of opposing vertical loop control sensors 78 supported by cross members connected to vertical members 82 of the frame 20. The sensors 78 control the variable speed drive motor 50 for the feed roll 48 so that the free flowing loop 75 always stays between the vertical guide rods 55. Suitable sensors are produced by Allen-Bradley and Banner Engineering Corp. The vertical members 82 of the frame 20 are supported by vertical side plates 84 of the frame and are rigidly connected by the cross members 58 and 59 (FIG. 2).

After the sheet metal strip S is directed downwardly between the vertical outer guide rods 55 from the loop 75, the strip S is directed between parallel spaced curved outer guide members or rods 85 and parallel spaced curved inner guide rods 86 which are continuations of the downwardly projections of the curved guide rods 73. The upper portions of the curved rods 85 and 86 are supported by horizontal cross members 88 and 89 of the frame 20. The lower end portions of the curved guide rods 85 and 86 are supported by vertical cross plates 92 and 94 of the frame 20 and are positioned so that the strip S is directed horizontally between an index roll 98 and an adjacent pinch roll 99. The index roll 98 is supported by end brackets or plates 103 secured to the vertical cross plate 94 of the frame 20, and the index roll 98 is driven by an electrical servo motor 105 (FIG. 2) also supported by one of the end plates 103 and the cross plate 94. The index roll servo motor 105 is controlled by operation of the mechanical reciprocating press 15.

The upper pinch roll 99 is supported by vertical arms or end plates 107 pivotally supported by corresponding shafts 109 which, in turn, are supported by end blocks mounted on the upper cross plate 92. Fluid or air cylinders 112 are also supported by the plate 92 and have piston rods 114 connected to pivot the arms or end plates 107 to control the downward pressure of the pinch roll 99 against the index roll 98. From the rolls 98 and 99, the strip S is directed horizontally into the press 15 on a guide and support plate 115 projecting from the press. However, the assembly of the index roll 98, pinch roll 99 and motor 105 may be supported by brackets mounted on the press.

As shown in FIG. 2, the axial length of the index roll 98 and the adjacent pinch roll 99 is substantially less than the width of the strip S so that the rolls only engage a longitudinal center portion of the strip S. Similarly, the continuously driven feed roll 48 and the adjacent pinch roll 46 have an axially length substantially less than the width of the strip S. The feeding and indexing of the strip S from the center portion of the strip S cooperates with the weight of the vertical loop 75 of the strip S so that the index roll 98 does not have to pull on the strip or lift a portion of the strip or drag the strip and is able to feed the strip S directly and smoothly at high speed into the die set tooling within the press and without the need of side or edge guide members for the strip S.

As shown in FIGS. 1 and 2, the frame 20 and all of the components of the strip feeding system 10, are supported by set of shock absorbers or vibration isolation mounts 118 which are mounted on a fabricated metal or steel base frame or support stand 120 having four vertical corner legs or posts 122 connected by horizontal cross members 123, 124, 125 and 126. A set of four air float or air film casters 130 are secured to the lower end portions of the corner posts 122 and provide for conveniently and quickly moving the entire unit or system 10 away from the press 15 when it is desired to service the press or die set tooling or exchange the tooling. The air casters 130 support the stand 120, and suitable air casters are produced by AeroGo, Inc. in Seattle, Wash. and sold under the trademark AEROGO.

When the system 10 is positioned for feeding or indexing the sheet metal strip S into the press, the frame 20 is rigidly and positively connected to the press 15 by a set of connector pins 134 each secured to a pair of end brackets 136 welded to the plates 103. The pins 134 are received within corresponding U-shaped recesses or cavities 138 formed within the top of a pair of connector arms 140 projecting from the press 15 under the pins 134. When the air casters 130 are supplied with pressurized air, the stand 120 and strip feeder system 10 are slightly elevated, and the pins 134 are lifted from the cavities 138 so that the stand 120 and system 10 are free to be conveniently and quickly moved away from the press 15.

Figure 3:
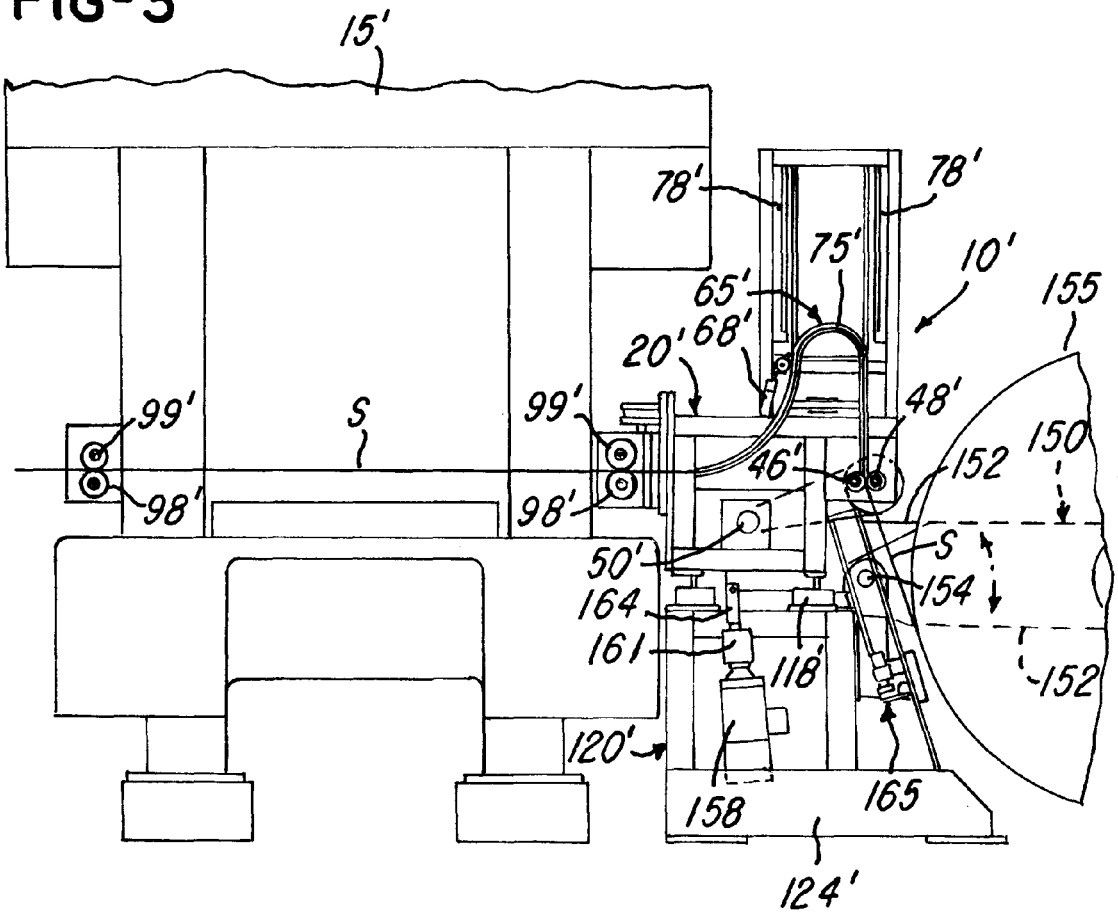
FIG. 3 is diagrammatic elevational view of a modified strip feeding system constructed in accordance with the invention and illustrating its installation on a reciprocating press.

Referring to FIG. 3 another embodiment of a thin sheet metal strip feeding system 10' is constructed in accordance with the invention for use with a powered uncoiler 150. One such uncoiler is produced by ASC Machine Tools, Inc. and is generally disclosed in above mentioned U.S. Pat. No. 5,451,011. Another uncoiler is produced by Perfecto Industries, Inc. as disclosed in above-mentioned U.S. Pat. No. 4,953,808. The uncoiler 150 includes a pair of parallel spaced arms 152 which are pivotally supported by corresponding pivot shafts 154 and support a coil 155 of thin sheet metal strip S. As the supply coil 155 reduces in diameter with the supply of strip S to the feeding system 10', the arms 152 are tilted or pivoted downwardly, to lower the center core of the roll 155, by a reversible electric motor 158 connected to a gearbox 161 which rotates a ball screw actuator 164 connected to the end portions of the arms 152.

The components of the strip feeding system 10' are substantially the same as the components of the system 10 and are identified with the same reference numbers but with the addition of prime marks. In the embodiment of FIG. 3, the leading end portion of the strip S is directed upwardly between the feed roll 48' and the adjacent pinch roll 46' by a conventional powered thread up mechanism 165. This mechanism requires that the strip S be directed upwardly between the feed roll 48' and pinch roll 46' at approximately the same angle regardless of the size of the coil 155. Thus the core of the coil 155 is lowered by the arms 152 as the coil reduces in diameter, and this adjustment is controlled by the motor 158.

As also shown in FIG. 3, the index roll 98' and pinch roll 99' are mounted on the frame 20' to form part of the system 10' and are located on one side of the mechanical reciprocating press 15' to advance the strip S horizontally into the die set tooling (not shown) within the press. Another set of power driven index roll 98' and pinch roll 99' are located on the opposite side of the press, and the second index roll 98' is also driven by a servo controlled electric motor 105. The servo motors are synchronized in order to produce a push/pull of the strip S through the press 15', which is especially desirable with a very thin and narrow aluminum strip.

From the drawings and the above description, it is apparent that a stock or strip feeding system constructed in accordance with the invention provides desirable features and advantages. More specifically, the vertical inverted loop system works with the variable speed feed roll and the servo driven index roll to provide the more consistent and smooth loop control and avoid whipping of the strip forming the loop, especially when the metal strip is very thin, for example, under 0.010 inch. The vertical loop control sensors 78 also provide for a very accurate loop control height so that the weight of the inverted U-shaped loop portion of the strip S between the vertical guide members or rods 55 cooperates with the feed roll 48 and the index roll 98 to assure a smooth and precise incremental advancement of the strip S into the press in response to operation of the press. The more accurate and precise feed advance or indexing of the strip S into the press enables a reduction or minimizing the feed distance or progression which results in a material cost savings for each stroke of the press.

As mentioned above, the strip feeding system 10 or 10' also permits an increase in production speed of the press, for example, from 400 strokes per minute to over 500 strokes per minute. The smooth high speed precision advance or indexing of the strip S into the press also provides for using thinner sheet metal stock or strip material which further contributes to cost reduction. The use of the feed and index rolls to engage only a center portion of the strip in combination with the vertical loop system provides for feeding the strip into the press without the need for side or edge guides for the strip and eliminates friction produced by edge guides. The center feeding and indexing of the strip also accommodates strip material with some camber while maintaining accuracy and high speed without jams of the system. In addition, the vibration isolation mounts 118 also cooperate to provide smooth feeding and indexing of the strip during high speed operation of the press and without pulling on the strip. The air flotation pads 130 on the lower base stand 120 further provide for easy and quick removal of the strip feeding system 10 from the press to provide convenient access to the press and/or die set tooling for servicing or replacement of the die set tooling. As another important advantage, the upward vertical loop system 10 or 10' eliminates the need for the index roll 98 to pull on or lift the strip, and the system further provides for minimizing the floor space required for precision high speed feeding a sheet metal strip into a reciprocating press.

While the forms of a strip feeding system herein described constitute preferred embodiments of the invention, it is to be understood that the invention is not limited to these precise forms, and that changes may be made therein without departing from the scope and spirit of the invention as defined in the appended claims.

What is claimed is:

1. Apparatus in combination with a wide thin sheet metal strip and for feeding said strip from a supply coil into a reciprocating press, said apparatus comprising a frame supporting a threading pinch roll and a horizontally adjacent threading feed roll connected to a variable speed drive motor, said threading feed roll and said pinch roll constructed to engage said strip in only a center portion substantially less than the width of said strip and positioned on said frame to receive said strip and direct said strip vertically upwardly, said frame including frame members projecting upwardly from said threading feed roll and supporting a first planar set of horizontally spaced elongated straight vertical guide rods in horizontally space relation to a second planar set of horizontally spaced elongated straight vertical guide rods, said first planar set and said second planar set of said vertical guide rods defining therebetween a vertically extending space of uniform horizontal width, said space defined between said first set and said second set of vertical guide rods receiving a continuously moving said strip from said threading feed roll and forming a vertically extending elongated loop within said strip, said vertical loop being movable upwardly within said vertically extending space and having parallel spaced elongated vertical strip portions adjacent said first set and said second set of said vertical guide rods, vertically extending elongated loop sensors supported by said vertical frame members adjacent said vertical guide rods and effective to detect the top of said vertical loop in said strip within said space between said vertical guide rods and connected to control said variable speed drive motor for said threading feed roll, an indexing feed roll and a vertically adjacent indexing pinch roll constructed to engage only a center portion of said strip substantially less than the width of said strip with said indexing feed roll driven by a servo motor controlled by said press to advance said strip in high speed successive increments substantially horizontally into said press, a plurality of horizontally spaced and parallel curved guide rods supported by said frame and extending downwardly from said second planar set of vertical guide rods and horizontally to said indexing feed roll to guide said strip to said indexing feed roll, and said loop having a vertical height substantially greater than a horizontal width of said loop between said first set and second set of said vertical guide rods and having sufficient weight for substantially eliminating a pulling force on said strip by said indexing feed roll to obtain high speed, smooth and precision advancement of said strip into said press.

2. Apparatus as defined in claim 1 and including connector members releasably connecting said frame to said press, a base stand adapted to be supported by a floor and positioned under said frame, a set of vibration isolation units mounted on said base stand and supporting said frame to avoid relative movement between said frame and said press when said press is operating and said stand is stationary on the floor, a set of air film casters supporting said base stand for horizontal movement on the floor, and said casters being effective to elevate said frame to provide for quickly moving said apparatus from said press to maintain or replace tooling on said press.

3. Apparatus for high speed, smooth and precision advancement of a wide thin sheet metal strip from a supply coil into a reciprocating press, said apparatus comprising a frame supporting a threading pinch roll and a horizontally adjacent threading feed roll connected to a variable speed drive motor, said threading feed roll and said pinch roll constructed to engage said strip in only a center portion substantially less than the width of said strip and positioned on said frame to receive said strip and direct said strip vertically upwardly, said frame including frame members projecting upwardly from said threading feed roll and supporting a first plurality of horizontally and laterally spaced elongated vertical guide rods in coplanar relation and in parallel space relation to a second plurality of horizontally and laterally spaced elongated vertical guide rods in coplanar relation, said first plurality and said second plurality of vertical guide rods defining therebetween an elongated vertically extending space of uniform width and receiving a continuously moving said strip from said threading feed roll and supporting an inverted U-shape elongated moving vertical loop within said strip, said vertical loop being movable upwardly within said vertically extending space and having parallel spaced elongated vertical strip portions adjacent said vertical guide rods with said loop having a vertical height to the top of said loop substantially greater than a horizontal width of said space between said first and second plurality of said guide rods, vertically extending elongated loop sensors supported by said vertical frame members adjacent said vertical guide rods and effective to detect the top of said inverted moving vertical loop in said strip between said parallel spaced vertical guide rods and connected to control said variable speed drive motor for said threading feed roll, an indexing feed roll and a vertically adjacent indexing pinch roll constructed to engage only a center portion of said strip substantially less than the width of said strip with said indexing feed roll driven by a servo motor controlled by said press to advance said strip in high speed successive increments substantially horizontally into said press, a plurality of horizontally spaced and parallel curved guide rods supported by said frame and extending from said second plurality of vertical guide rods downwardly below said feed roll and horizontally to said indexing feed roll to guide said strip to said indexing feed roll, connector members releasably connecting said frame to said press, a base stand adapted to be supported by a floor and positioned under said frame, a set of vibration isolation units mounted on said base stand and supporting said frame to avoid relative movement between said frame and said press when said press is operating and said stand is stationary on the floor, said connector members being effective to disconnect said frame from said press in response to elevating said base stand, a set of air film casters supporting said base stand for horizontal movement on the floor, and said casters being effective to elevate said frame and disconnect said frame from said press to provide for quickly moving said apparatus from said press to maintain or replace tooling on said press.

* * * * *